United States Patent [19]

Hartmann et al.

[11] 4,305,986

[45] Dec. 15, 1981

[54] TUFTED CARPETING

[75] Inventors: Ludwig Hartmann; Ivo Ruzek, both of Kaiserslautern, Fed. Rep. of Germany

[73] Assignee: Carl Freudenberg, Fed. Rep. of Germany

[21] Appl. No.: 163,799

[22] Filed: Jun. 27, 1980

[30] Foreign Application Priority Data

Apr. 2, 1980 [DE] Fed. Rep. of Germany ..... 3012806

[51] Int. Cl.[3] ..... B32B 3/02; B32B 33/00; D04H 1/58

[52] U.S. Cl. ..... 428/95; 428/198

[58] Field of Search ..... 428/95, 198, 288, 296; 264/75; 156/272, 72

[56] References Cited

U.S. PATENT DOCUMENTS 3,554,854 1/1971 Hartmann ..... 264/75

4,107,374 8/1978 Kusunose ..... 428/288

*Primary Examiner*—Marion McCamish

*Attorney, Agent, or Firm*—Keil & Witherspoon

[57] ABSTRACT

Tufted carpeting having a prime, fabric backing, pile yarn on the front face of and anchored in said prime backing by a latex, a secondary backing covering the rear face of said prime backing and bonded thereto by the latex layer between said backings, said secondary backing being a non-woven fabric made of several, superposed layers of polyester and/or copolyester endless filaments or threads which are deposited in the layers in a tangled arrangement of individual filaments or threads and groups of two or more filaments or threads which lay in part parallel with each other, said filaments or threads being at least partly interbonded and laid in a crossed, parallel texture in the layers by heat and pressure or by a binder applied at spaced intervals, and the spacing between filaments and the applications of binder providing the secondary backing with an air permeability, measured at 0.5 mbar excess air pressure, of at least 120, preferably at least 500, $dm^3m^2 \cdot s$ and a weight per unit area in the range of 4 to 150 grams per square meter.

8 Claims, 2 Drawing Figures

TUFTED CARPETING

STATEMENT OF THE INVENTION

The invention herein relates to improvements in carpeting and particularly to improvements in carpeting with a secondary backing made of a fabric composed of several layers of endless threads or filaments which are interconnected and tangled among each other. A mixture of individual filaments and filament groups (two or more, substantially parallel, side-by-side filaments) are, in certain places in the backing, disposed parallel with other filaments or filament groups, and the individual filaments and filament groups are wholly or partly interconnected to form a crossed, parallel texture. The variation coefficient of filament separation is more than 100%, preferably more 120%. The variation coefficients are defined below.

The individual filaments and filament groups may be interconnected by bonding with a secondary binder. The non-woven fabric of endless filaments has an air permeability, measured at an excess pressure of 0.5 mbar, of at least 120, effectively of at least 500 $dm^3/m^2 \cdot s$. The filaments preferably are polyesters or copolyesters. The non-woven fabric has a weight per unit area in the range of 4 to 150 grams per square meter. The thickness of the non-woven fabric may be varied throughout by using screen-like, spaced, imprinted areas of the secondary binder and/or dye pigment-binder combinations.

BACKGROUND

Tufted carpets are multilayer, pile textiles. They are manufactured on special machines on which the pile yarn is joined but not tied, by means of needles, with a base layer, which in the case of carpets today consists almost exclusively of synthetic fibers. The anchoring of the pile yarn is accomplished by a subsequent coating of the reverse side of the base layer with natural or synthetic rubber or with polyvinyl chloride (PVC). The rubber coating moreover is joined to a so-called secondary backing, which as a rule consists of an elastomer foam or a woven or non-woven textile material.

Tufted products find many uses, for example, as carpets, runners, textile tiles, bedspreads, bath mats, etc. In their production, the secondary backing in particular is of considerable importance. The task of the secondary backing is, on the one hand, imparting a better stability to the tufted carpet and on the other hand creating easy slidability on other surfaces, e.g., when the carpet having the secondary backing is to be laid on a carpet pad, which also should have a layer of an easily sliding textile material. Only then will there be an assurance that when laying the carpet from wall to wall, no lasting undulations will form as a result of deformations of both layers, developing from walking on it or from some other use. The undulations or waves affect the appearance and possibly may even be a danger to the user.

PRIOR ART

Originally, tufted rugs were made with secondary backings of jute fabrics. Even today jute fabrics are still the most commonly used materials, because they do not only fulfill the above listed tasks but even cause the appearance of the tufted carpet to resemble classically woven carpets more closely. Nevertheless jute fabrics have their shortcomings for the present purpose. They fulfill the most important requirements of stabilization of dimensions and of increase in strength, which is needed because of the weakening of the primary tufting carrier caused by the penetration of the tufting needle. To a degree, they also satisfy the requirement that the carpet slide on the pad. However, jute fabrics are not resistant against rot and frequently are the only non-synthetic component of the entire carpet construction. It is furthermore a disadvantage that microorgansims, such as bacteria and fungi, multiply in this layer, which degrade the hygienic suitability of the carpet. Another essential disadvantage is the high weight per square meter of more than 200 $g/m^2$, which must be used in order to achieve the necessary dimensional stability and strength characteristics. Finally jute is a natural product which is available only in limited quantities.

More recently, attempts have been made to develop carpets with a secondary backing made of polypropylene filaments. Conventional fabrics and bonded, non-woven fabrics were used. The most serious disadvantage of such secondary backings is their lack of thermal stability. When using higher temperatures, such articles are inclined to shrink. The finished carpet provided with polypropylene secondary backings leads to a bi-metal effect, causing some waviness. Furthermore, problems of adhesion occur during lamination with the raw carpet. In the lamination, synthetic rubber latices as a rule are used to anchor the pile in the pile carrier layer and are also used as an adhesive mass for lamination with the secondary backing. In case of polypropylene fabrics, there is inadequate bonding thereto by the rubber latices. To improve the bonding, various measures must be taken, for example, perforations are incorporated in the bonded fabrics or spinning yarns are used in the woven polypropylene backings. Even then, however, the bonding with the raw carpet is still imperfect.

DETAILED DESCRIPTION OF THE INVENTION

Figure 1:
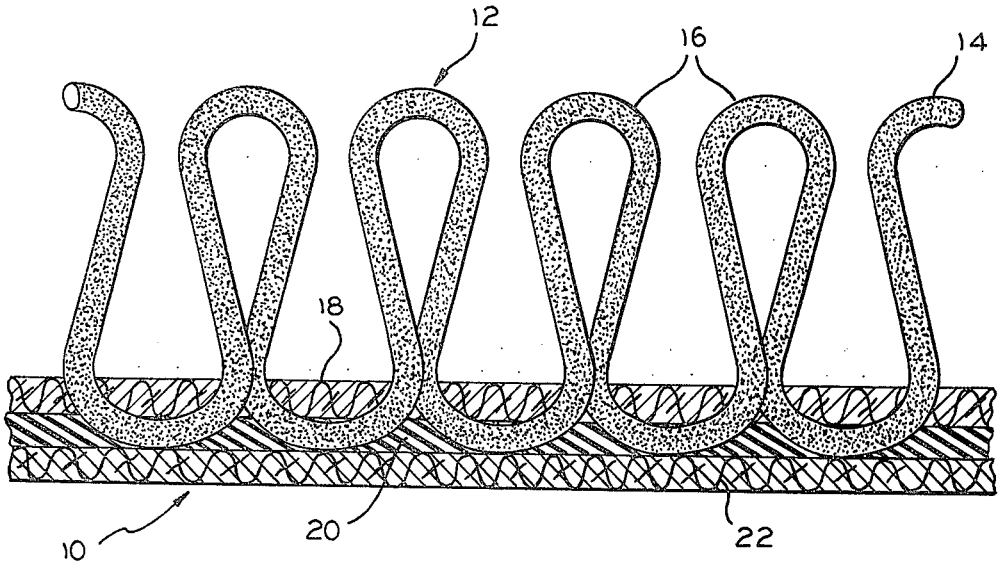

The invention provides tufted carpeting which does not have the previously explained disadvantages and which is distinguished especially by a low weight per unit area, good thermal stability and great strength with good adhesion and stability of shape. The secondary backing can be made with optimum porosity, and its endless filaments are easily and lastingly bonded together.

The objectives are achieved by a tufted carpet having a secondary backing made of an endless filament-bonded fabric composed of several layers of tangled threads or filaments, which are interconnected and interbonded. The threads or filaments and filament groups are polyesters and/or copolyesters and are disposed in a cross-over, parallel texture. In this case, endless filament-bonded fabrics in the form of spun bonded fabrics are especially suitable. The porosity and filament adhesion in the secondary backing are adjusted at the same time by a certain degree of filament separation, described below.

The secondary backing of polyester filaments, arranged in crossed parallel structure according to the invention, has a high dimensional stability, very good strength characteristics and an excellent adhesiveness on the tufted carpet, as well as a good appearance. These qualities are achieved by group-like spinning of the filaments, or by joint drawing off or reeling off of spun polyester threads or filaments, and their joint deposition in the non-woven fabric with crossed parallel structure and defined porosity. A flat shaped article with good adhesive characteristics results, which is laminated, for example, with the help of rubber latices with the tufted carpet. An optimum porosity for lamination can be obtained in the case of a bonded fabric which has been produced from filaments obtained by group-like spinning of the polyester filaments as in U.S. Pat. No. 3,554,854. The porosity of the bonded fabric may be adjusted, depending on the percentage and the degree of parallelization of the filaments in the groups with a given weight per unit area. As a result subsequent needling, as was customary in the prior art to obtain a favorable surface structure for bonding the carpet together, becomes unnecessary. In the secondary backing of the invention, an increase in the tighter bundling of the filaments in filament groups at a predetermined weight per unit area leads to an increase of the porosity of the flat shaped article. By building up the spun bonded fabric from filament groups, the porosity and thus the adhesive characteristic may be adjusted, depending on the number of the individual filaments per filament group.

In the carpet of the invention, a multi-filament, endless-filament, bonded, non-woven fabric, preferably a spun bonded fabric, is employed wherein multiple filament groups are intermixed, and wherein there also are individual filaments present, which are bonded with the filament groups, at least at the points of crossing. By flat piling up of the interconnected filament groups, i.e., multifilaments of a different filament number, which are deposited tangled and are mixed with individual filament groups, there results a great strength after bonding together whereby the individual filaments serve as binding agents for the stabilization of the flat fabric, either by serving as binding fibers due to their lower softening point, or by functioning as binding agents, based on their free length and large surface, for the strands where secondary binders, e.g., dispersions, are used.

The multifilaments need not be in the form of endless, interbonded strands, but the individual filaments forming the multifilament groups may also be bonded in sections into the multifilament. In many cases bonding together by sections alone suffices to achieve optimum characteristics. The entire bonded fabric is bonded like any other bonded fabric, by bonding the filaments or threads together at the crossing points, either by binding fibers or with the help of secondary binders, for example, in the form of a binder dispersion. As a result the bond of the bonded fabric is stabilized by fixed binding points or areas at the points of crossing, and it will be sufficient that the multifilaments are bonded together over such lengths as are determined by the number of crossing points. Since, in practice, the bonded multifilament fabric is mixed with individual filaments, a multifilament structure, i.e., one having its individual filaments interconnected in parallel, is produced over certain portions of the lengths of the filament groups, while on other portions there are individual filaments in parallel which might even separate in certain areas into individual filaments and which in other areas are together.

ILLUSTRATED EMBODIMENTS

Figure 2:
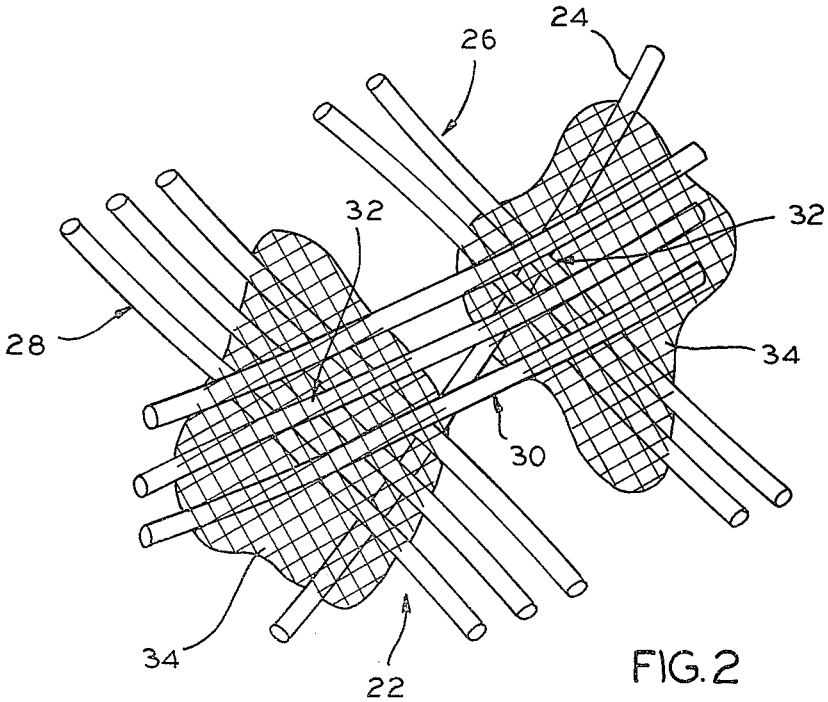

Preferred forms of the invention are illustrated in the drawings, wherein:

FIG. 1 is a schematic cross-section of a loop pile carpet using a secondary backing of the invention; and FIG. 2 is an enlarged, schematic, plan view of a segment of the secondary backing.

Referring to FIG. 1, the tufted carpet 10 has pile 12 composed of pile yarns 14 in the form of loops 16 anchored in the fabric, prime, tuft-carrier backing 18. The prime backing 18 may be either a bonded, non-woven fabric or a woven fabric.

The pile 12 may also be made from cut pile yarns (not shown) instead of loop pile yarns. In either case, the pile yarns are anchored in the prime backing 18 by a rubber or PVC latex coating 20, by which the secondary backing layer 22 is adhered to the prime backing layer 18.

In the embodiment as shown in FIG. 2, the secondary backing 22 is composed of individual filaments 24 and groups or bundles 26, 28 and 30 each composed of two or three parallel filaments. They are laid in layers in a cross-over, parallel texture and are bonded at their cross-over points 32 with the aid of applications 34 of a secondary binder.

As a result of the porosity of the bonded fabric, resulting from the directed bundling of the filaments, a good penetration of the latices or other adhesives, used in lamination of the carpet layers, is ensured. The secondary backing of the invention made of continuous polyester filaments with the directed degree of parallelism of the filament groups, distributed in the scatter texture results in a first rate adhesion of the prime and secondary backings in the tufted carpet. The bonding may be improved still further by the fact that the bonded fabric consists not only of the traditional polyester filaments made of polyethylene terephthalate but also of a mixed polyester bonded fabric. This mixed bonded fabric preferably also contains copolyester filaments or threads added by spinning or added from spools, reels, etc.

It was found that copolyester filaments or threads, during lamination of the carpet, have considerably better adhesion than do the traditional polyester threads or filaments. The surface characteristics with regard to the adhesion of the spun-bonded fabric are considerably improved by the addition and admixture of the copolyester threads. The addition by spinning or simple addition of copolyesters from ethylene glycol, terephthalic acid and adipic acid, or butylene glycol, terephthalic acid and adipic acid, or butylene glycol, terephthalic acid and isophthalic acid has proven itself.

In one type of embodiment of the invention, for lamination with the raw carpet prime backing, the spun bonded fabric of the secondary backing is built up of endless filaments or filament groups in crossed, parallel texture, wherein the filament groups are built up of defined mixtures of polyester filaments and copolyester filaments. The best mixing ratio may easily be determined by preliminary experiments. The deposition of the individual filaments and filament groups in crossed parallel texture, i.e., without a preferred direction of the laying of the deposited filaments, results both in isotropic strength characteristics as well as in a directed pore construction and therefore produces an ideal reinforcing material for the carpet. Mixtures of polyester filaments and copolyester filaments in a mixing ratio of 85:15 to 72:25 have proven themselves especially useful.

A further improvement of the secondary backing of spun bonded fabric may be achieved by point or screen type imprinting of binders or dyes or dye-pigment binder combinations. Here not only is a geometric woven fabric-like texture achieved, but likewise there results a local compaction which permits an optimum pore structure. The adhesive, e.g., rubber or PVC latices, used for lamination of the finished carpet penetrates the places of compression less strongly than the more porous, adjacent places, as a result of which a certain suction effect and high adhesive values will be achieved. In this case, as will be described later, a certain permeability by air is adjusted, i.e., the degree of the surface closing is adjusted on the one hand by a certain degree of the filament separation and on the other hand by a local overprinting on the basis of the permeability to air. The imprint of the additional binder or of the dye pigment-binder combination is illustrated in FIG. 2. Here the individual filaments 24 and the filament groups 26,28,30 are provided with the binder at the points of crossing, whereby the areas 34 of the binder may be overprinted additionally with the binder (for example, a polyarylate).

With due consideration for the principle for the construction of the secondary backing of the invention, it is also possible to produce the bonded fabric in crossed parallel texture from polyester filaments or filament groups, possibly in admixture with the copolyester filaments or filament groups, not only as spun-bonded fabric i.e., filaments coming directly from the spinneret, but also by drawing off these filaments or filament groups from bobbins, reels or cops of earlier spun and drawn filaments or threads and subsequent deposition thereof in the crossed-over, parallel texture to form the fabric.

Fundamentally a bonded fabric of the invention and for the production of tufted carpets, which consist of filaments deposited in crossed-over, parallel texture and of continuously changing filament groups which are possibly deposited irregularly, is to be designated as "bonded fabric with crossed-over, parallel texture". This structure is clearly apparent from FIG. 2. It is characterized by a high variation coefficient of the filament separation which points to a strong bundling. This specific structure causes two things:

1. The high number of filaments per unit area produces the strength values and mechanical characteristics needed for the fabric.
2. By selection of the degree of parallelization of the threads, the porosity may be adjusted, which is needed for the bonding of the secondary backing on the tufted carpet.

A porosity, to which an air-permeability at an excess pressure of 0.5 mbar of at least 120, preferably however more than 500, $dm^3/m^2 \cdot s$ corresponds, is considered the optimum. The degree of the parallelization may be defined by measuring the variation coefficient of the filament separation.

The determination of the variation coefficients of the filament separation rests on the measurement of the distance between the individual filaments of the bonded fabric. From this its variation coefficient may be calculated. Thin bonded fabrics to about 0.15 mm thickness may be measured directly. In case of thicker fabrics a splitting process is required, which to be sure must not change the filament positions. In case of unbonded or not bonded materials, under which the bonded fabrics of the invention are also applicable as a rule, the splitting process takes place by direct delamination. In case of more solidly bonded materials it will be effective to embed them first in a suitable material, and to split them with a microtome into about $1\mu$ thick layers.

The measurement of the distance between the individual filaments is accomplished effectively on a microscope with 50 times magnification, wherein the microscope is equipped with a measuring ocular. The distance, always of the filaments lying in parallel, is measured in both main directions (longitudinal and transverse), as well as the distance in both diagonal directions, which lie at an angle of $\pm 45°$ in relation to the main axes. Filaments which are defined as being parallel form an angle of $0° \pm 2°$ with the pertinent degrees of direction. The distance between adjacent sides of parallel filaments is called the distance between two filaments. The number of the measured filament distances is to amount for each sample to at least 200, better still to about 400. In case of the measurement, an imaginary straight line, which follows the direction to be measured, is divided, and the distances of those filaments which intersect with this straight line at an angle of $90° \pm 2°$, are taken into consideration.

The variation coefficients of the separation are calculated according to the formula:

$$V_{FS} = \frac{S}{x} \cdot 100\ (\%)$$

where $V_{FS}$ represents the variation coefficient of the film separations, S the standard deviation of the measuring collective $$S = \frac{(x_i - \bar{x})^2}{n - 1}$$

$x_i$ is the pertinent individual value of filament distance, n the number of measurements and $\bar{x}$ the average filament distance $$\bar{x} = \frac{\Sigma x_i}{n}.$$

Beside setting the above parameters of the air permeability and filament separation, the weight per unit area also proved to be a functional characteristic. In case of weights per unit area of less than 40 $g/m^2$, the necessary air permeability could be adjusted by correspondingly high overpressure, but the necessary reinforcement of the finsished carpet was too low. In case of weight over 150 $g/m^2$ it was possible by corresponding adjustment of the filament separation or group formation to achieve both high mechanical strengths as well as good bonding together by adjusting a corresponding porosity, measured by the air permeability. However, in case of weights per unit area of over 150 $g/m^2$ the secondary backings inclined toward longitudinal splitting, which must be avoided under all circumstances. Therefore, preferably and according to the invention, weights of 40 $g/m^2$ to 150 $g/m^2$ are used.

Preferred embodiments of the invention are further illustrated in the following Examples.

EXAMPLE 1

A printed looped fabric, tufted in separations of 5/64" with 54 needlings per cm, was coated by means of a padding device with a styrene-butadene latex. The latex was filled with 15% by weight of chalk, and 700 $g/m^2$ of this mixture were applied. The padding device consisted of two steel rolls disposed in tandem, in succession, which revolved with a lead of 15% in the running direction, as compared to speed of the web of the carpet. A polyester-copolyester spun-bonded fabric was used as the secondary backing, which had a crossed-over, parallel texture in accordance with the invention and had the following characteristics:

| | | |
|---|---|---|
| Weight per unit area | $g/m^2$ | 50 |
| Thickness | mm | 0.24 |
| Maximum tension | N/5cm lengthwise | 107 |
| | across | 98 |
| Maximum stress-strain % | lengthwise | 38 |
| | across | 38 |
| Air permeability at 0.5 mbar in $dm^3/m^2 . s$ | | 1950 |
| Variation coefficient of the filament separation % | | 138 |

The secondary backing was laminated onto the coated carpet and was dried subsequently, after the latex passed through gelling-stage. Drying was provided with an infrared radiator.

The finished carpet had very good laying characteristics. The adhesion of the second backing was perfect.

EXAMPLE 2

The method of Example 1 was employed. A polyester (polyethylene terephthalate) endless filament, bonded fabric with a fiber weight of 80 $g/m^2$ was used as the secondary backing. The fabric was printed with 10 $g/m^2$ acrylate binder. The resulting bonded fabric, after drying, had a weight per unit area of 90 $g/m^2$ and the following values:

| | | |
|---|---|---|
| Thickness | mm | 0.30 |
| Maximum tension | N/5cm lengthwise | 190 |
| | across | 183 |
| Elongation % | lengthwise | 63 |
| | across | 63 |
| Air permeability at 0.5 mbar in $dm^3m^2 . s$ | | 560 |
| Variation coefficient of the filament separation % | | 162 |

After lamination it was found that the adhesion of the secondary backing to the carpet was very good. The characteristics of the carpet with respect to the laying down of the carpet and how it lay on the floor were perfect.

The invention thus embraces tufted carpeting having a prime, fabric backing 18, pile yarn 14 on the front face of and anchored in said prime backing by a latex layer 20. A secondary backing 22 covers the rear face of said prime backing and is secured thereon by the latex layer between said backings. The secondary backing is a non-woven fabric made of several, superposed layers of endless filaments or threads of a polyester and/or copolyester which are deposited in the layers in a tangled arrangement. The filaments or threads in each layer are composed of individual filaments or threads and groups of two or more filaments or threads which lay in part parallel with each other (FIG. 2). The filaments or threads are at least partly interbonded and laid in a crossed, parallel texture in the layers, and they are separated in said crossed, parallel texture to the degree providing a variation coefficient of filament separation of more than 100%, preferably more than 120%. The latex penetrates the porous secondary backing to provide an excellent bonding of the secondary backing to the raw carpet.

The filaments or threads may be interbonded by heating the secondary backings and application of pressure at spaced intervals or by spaced applications 34 of a secondary binder, as shown on FIG. 2.

The invention is hereby claimed as follows:

1. Tufted carpeting comprising a prime, fabric backing, pile yarn on the front face of and anchored in said prime backing, a secondary backing covering the rear face of said prime backing and a latex layer between said backings, said secondary backing being a non-woven fabric made of several, superposed layers of endless filaments or threads which are deposited in the layers in a tangled arrangement, said filaments or threads in each layer being composed of individual filaments or threads and groups of two or more filaments which lay in part parallel with each other, said filaments or threads being at least partly interbonded and laid in a crossed, parallel texture in the layers, and said filaments being separated in said crossed, parallel texture to the degree providing a variation coefficient of filament separation of more than 100%.

2. Tufted carpeting as claimed in claim 1, wherein said filaments are interbonded by a secondary binder, and the filaments being separated in the crossed, parallel texture to the degree providing a variation coefficient of filament separation of more than 120%.

3. Tufted carpeting as claimed in claims 1 or 2, characterized by said secondary backing having an air permeability, measured at 0.5 mbar excess air pressure, of at least 120 $dm^3/m^2 \cdot s$.

4. Tufted carpeting as claimed in claims 1 or 2, characterized by said secondary backing having an air permeability, measured at 0.5 mbar excess air pressure, of at least 500 $dm^3/m^2 \cdot s$.

5. Tufted carpeting as claimed in claims 1 or 2, wherein said filaments are polyester filaments and/or copolyester filaments.

6. Tufted carpeting as claimed in claims 1 or 2, wherein said filaments are both (a) polyethylene terephthalate filaments and (b) copolyester filaments consisting of ethylene glycol, terephthalic acid and adipic acid, of butylene glycol, terephthalic acid and adipic acid and/or of butylene glycol, terephthalic acid and isophthalic acid, in a ratio of (a) to (b) in the range of about 85:15 to 75:25.

7. Tufted carpeting as claimed in claims 1 or 2, wherein said filaments in the crossed, parallel texture of said secondary binder are imprinted in spaced areas with a secondary binder and/or a dye pigment-binder in amounts providing variations in thickness of the secondary backing.

8. Tufted carpeting as claimed in claims 1 or 2, wherein said secondary backing has a weight per unit area in the range of 4 to 150 grams per square meter.

* * * * *